US005752743A

United States Patent [19]

Garelik

[11] Patent Number: 5,752,743

[45] Date of Patent: May 19, 1998

[54] FOLDING FURNITURE CONSTRUCTION

[76] Inventor: Michael Garelik, 9 Lincoln Street, Jerusalem, Israel

[21] Appl. No.: 739,702

[22] Filed: Oct. 29, 1996

[51] Int. Cl.[6] ..... A47C 4/00

[52] U.S. Cl. ..... 297/440.12

[58] Field of Search ..... 397/440.12, 14

[56] References Cited

U.S. PATENT DOCUMENTS

| | | | |
|---|---|---|---|
| 3,149,880 | 9/1964 | Steuer | 297/440.12 |
| 3,178,227 | 4/1965 | Snyder | 297/440.12 |
| 3,295,890 | 1/1967 | Murdoch | 297/440.12 X |
| 3,604,751 | 9/1971 | Caigan | 297/440.12 |
| 4,085,970 | 4/1978 | Klein | 297/440.12 |
| 4,556,253 | 12/1985 | Geneve et al. | 297/440.12 |
| 4,648,658 | 3/1987 | Calco | 297/440.12 |
| 4,877,292 | 10/1989 | Volpe et al. | 297/440.12 |
| 4,970,831 | 11/1990 | Rota | 297/440.12 X |
| 4,984,848 | 1/1991 | Scalisi et al. | 297/440.12 |
| 5,382,081 | 1/1995 | Henry | 297/440.12 |

FOREIGN PATENT DOCUMENTS

| | | | |
|---|---|---|---|
| 2248672 | 5/1975 | France | 297/440.12 |
| 1654350 | 2/1971 | Germany | 297/440.12 |
| 2279556 | 1/1995 | United Kingdom | 297/14 |

*Primary Examiner*—Peter M. Cuomo
*Assistant Examiner*—David E. Allred
*Attorney, Agent, or Firm*—Mark M. Friedman

[57] ABSTRACT

A foldable furniture structure includes a first panel element and a second panel element hingedly attached at at least three non-collinear points along its upper edge to the lower surface of the first panel. The attachment allows the structure to be folded between a closed state in which the first and second panel elements are substantially parallel and adjacent, and an open state in which the first panel element is at an angle to the second panel element. The non-collinear attachment induces flexing of the first and second panel elements in the open state such that the second panel element forms a load-bearing leg structure for supporting the first panel element. The panel elements may be made from semi-flexible sheet material, or from rigid panels attached along hinges. Preferably, the second panel element is implemented as a collapsible tube formed from semi-flexible sheet-like material, the tube being foldable along two opposite longitudinal folds to a substantially flat arrangement when the structure assumes its closed state, and a hollow substantially cylindrical open arrangement when the structure assumes its open state. A seat-back panel element may also be provided.

18 Claims, 9 Drawing Sheets

FOLDING FURNITURE CONSTRUCTION

FIELD AND BACKGROUND OF THE INVENTION

The present invention relates to furniture and, in particular, it concerns a folding construction for load-bearing furniture.

It is known to provide folding chairs to allow convenient storage of spare chairs and seasonal garden furniture. Such chairs are usually built as rigid substructures made of wood, plastic or tube-metal which are hinged together so as to collapse to a reduced size for storage.

Since the substructures of folding chairs are made of intrinsically rigid load-bearing materials, they are typically quite heavy and bulky. This weight and bulk makes them inconvenient to handle and transport, even when folded.

In order to achieve efficient folding, the seat and back-rest elements of folding chairs are usually made planar, rendering them uncomfortable for extended use. Conversely, if they are constructed with ergonomic curvature, the fixed curvature of the seat and back-rest elements results in a larger folded size.

There is therefore a need for highly compact, light-weight folding furniture structures. It would also be highly advantageous to provide a folding chair which has ergonomic curvature in its open state, and which folds to a highly compact, parallel-layered closed state.

SUMMARY OF THE INVENTION

The present invention is a foldable furniture structure for supporting a load.

According to the teachings of the present invention there is provided, a foldable furniture structure for supporting a load above a floor, the structure comprising: (a) a first panel element having an upper surface for supporting a load and a lower surface; and (b) a second panel element having a lower edge for resting on the floor and an upper edge hingedly attached at at least three non-collinear points to the lower surface of the first panel, the attachment being such that the structure is foldable between a closed state in which the first and second panel elements are substantially parallel and adjacent, and an open state in which the first panel element is at an angle to the second panel element, the non-collinear attachment inducing flexing of the first and second panel elements in the open state such that the second panel element forms a load-bearing leg structure for supporting the first panel element above the floor.

According to a further feature of the present invention, the second panel element is formed from a sheet of semi-flexible material.

According to a further feature of the present invention, the semi-flexible material has an internal structure of elongated parallel cells, the semi-flexible material being orientated such that the elongated parallel cells extend in a direction from the lower edge to the upper edge of the second panel element.

According to a further feature of the present invention, the semi-flexible material is resiliently biased towards a slight curvature corresponding to the curvature of the second panel element in the open state.

According to an alternative feature of the present invention, the second panel element is formed from at least three rigid panels arranged side-by-side and providing abutting edges which are hingingly interconnected, the abutting edges extending in a direction from the lower edge to the upper edge of the second panel element.

According to a another alternative feature of the present invention, the second panel element is formed from a plurality of parallel rigid rods extending in a direction from the lower edge to the upper edge of the second panel element, the rods being connected and held in spaced inter-relation by semi-flexible connecting material.

According to a further feature of the present invention, the second panel element is attached to the lower surface of the first panel element by an array of hinges.

According to an alternative feature of the present invention, the second panel element is attached to the lower surface of the first panel element by a single continuous hinge.

According to a further feature of the present invention, the continuous hinge is formed by heat-welding a polymer material.

According to a further feature of the present invention, the upper edge of the second panel element forms a concave curve.

According to an alternative feature of the present invention, the upper edge of the second panel element forms a truncated V-shape.

According to another alternative feature of the present invention, the upper edge of the second panel element is shaped to impart an ergonomic seat contour to the first panel element.

According to a further feature of the present invention, the second panel element is implemented as a collapsible tube formed from semi-flexible sheet-like material, the tube being foldable along two opposite longitudinal folds to a substantially flat arrangement when the structure assumes its closed state, and a hollow substantially cylindrical open arrangement when the structure assumes its open state.

According to a further feature of the present invention, there is also provided a hinge element attaching an edge of the first panel element to the wall.

According to a further feature of the present invention for use as a chair, there is also provided a third panel element having a lower edge hingedly attached at at least three non-collinear points to the upper surface of the first panel such that the third panel element lies substantially parallel and adjacent to the first panel element when the structure is in its closed state, and the third panel element assumes an upright position at an angle to the first panel element, when the structure is in its open state, thereby forming a back rest.

According to a further feature of the present invention, there is also provided a locking mechanism for maintaining the structure in the open state.

There is also provided, according to a further feature of the present invention, a folding chair for supporting a subject above a floor, the chair comprising: (a) a tube formed from semi-flexible sheet-like material, the tube being foldable along two opposite longitudinal folds such that the tube is deployable between a substantially flat folded state and a hollow substantially cylindrical open state, the tube having a lower edge for resting on the floor and an upper edge; and (b) a seat element hingedly attached at at least one point to the upper edge of the tube such that, when the tube is in its folded state, the seat pivots to a storage position adjacent to the folded tube, and when the tube is in its open state, the seat element is pivotable to a deployed position in which it rests on a major portion of the upper edge to form a chair.

According to a further feature of the present invention, the seat element is shaped such that, when in the deployed position, the seat element pushes outwards against at least part of the upper edge of the tube so as to maintain the tube in its open state.

According to a further feature of the present invention, the seat element includes two panel elements hingingly attached at at least three non-collinear points, the two panel elements being deployable between a folded state in which they are substantially parallel and adjacent, and a seat-forming state in which they are angled apart.

According to a further feature of the present invention, the seat element is hingedly attached to the upper edge of the tube at at least three non-collinear points.

According to a further feature of the present invention, there is also provided a catch for releasably locking the seat element in the deployed position.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a foldable furniture structure for supporting a load.

The principles and operation of structures according to the present invention may be better understood with reference to the drawings and the accompanying description.

Figure 1A:
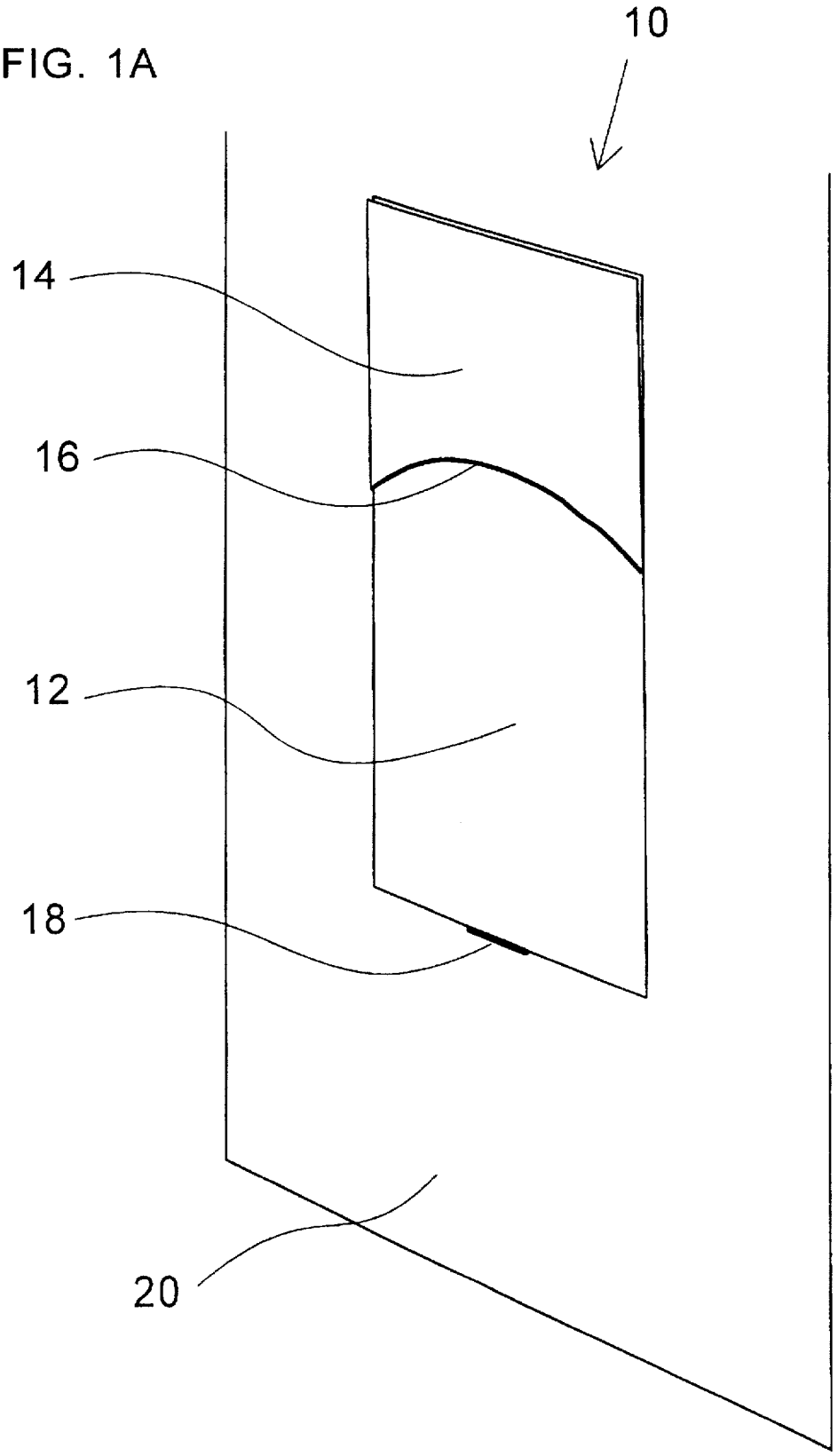
FIG. 1A is a schematic perspective view of a first embodiment of a foldable furniture structure, constructed and operative according to the teachings of the present invention, in a closed state.
Figure 1B:
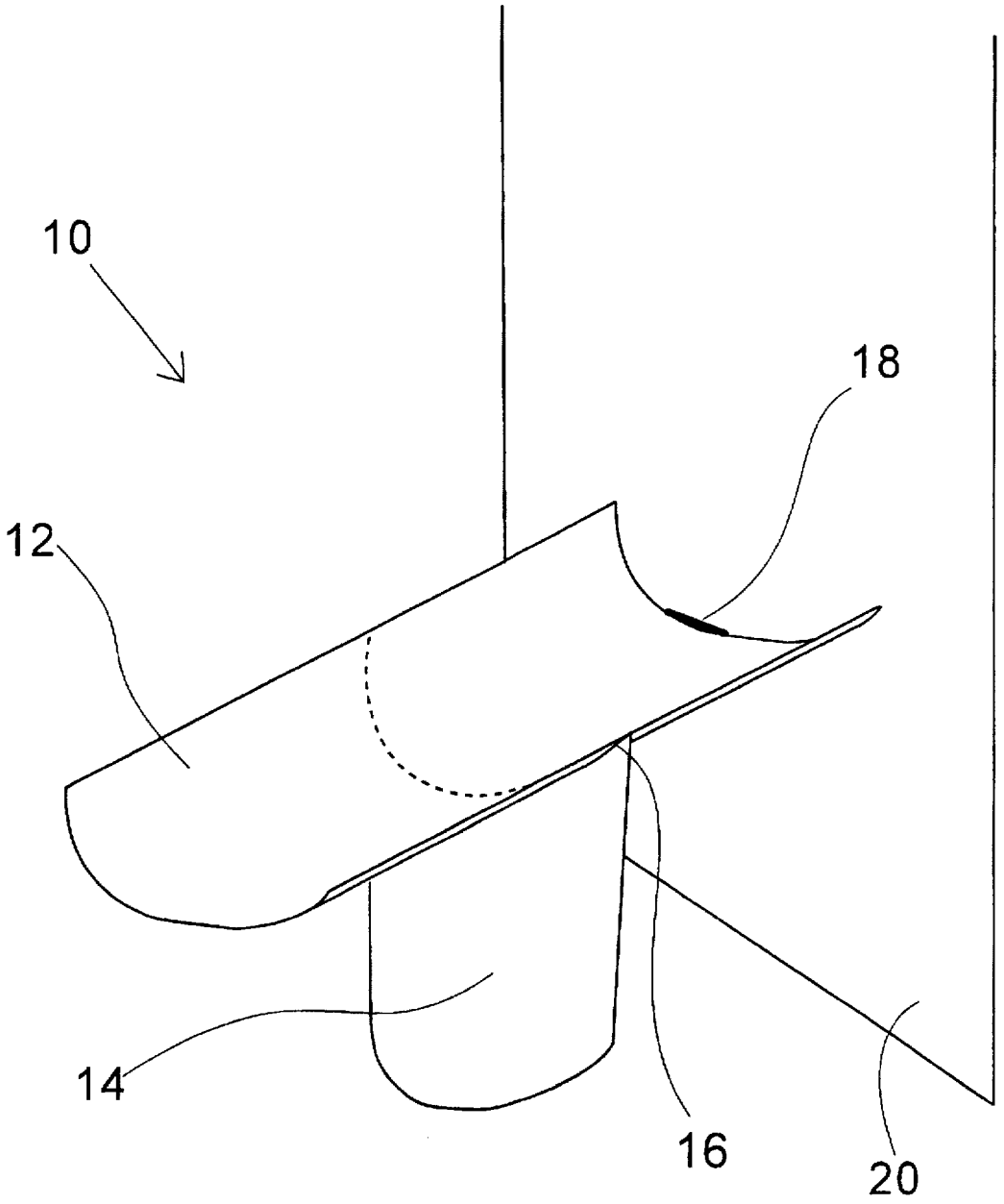
FIG. 1B is a schematic perspective view of the embodiment of FIG. 1A in an open state.

Referring now to the drawings, FIGS. 1A and 1B show a first embodiment of a foldable furniture structure, generally designated 10, constructed and operative according to the teachings of the present invention, for supporting a load above a floor. In general terms, structure 10 has a first panel element 12 for forming a generally horizontal load-bearing surface, and a second panel element 14, hingedly attached to the lower surface of panel element 12, for forming a load-bearing leg structure.

It is a particular feature of preferred embodiments of the present invention that the upper edge 16 of second panel element 14 is hingedly attached to the lower surface of first panel element 12 at at least three non-collinear points in such a way that structure 10 is foldable between a closed state (FIG. 1A) in which first panel element 12 and second panel element 14 are substantially parallel and adjacent, and an open state (FIG. 1B) in which first panel element 12 is at an angle to second panel element 14. The non-collinear attachment of the panels induces flexing of the panel elements in the open state, thereby imparting structural integrity to second panel element 14 which becomes a load-bearing leg structure for supporting first panel element 12 above the floor.

It should be understood that the term "flexing" is used in the context of the description and claims to refer both to bending of intrinsically flexible material and to flexing about an in-built hinge.

Correspondingly, the term "panel element" is used in the context of the description and claims to refer to a wide range of different structures made from a wide range of different materials or combinations thereof. Specifically, the term "panel element" is hereby defined to include both a single-element panel made from sheet material flexible in at least one direction, and a compound structure made up from a number of panels joined together by hinges.

Turning now to the features of structure 10 in more detail, second panel element 14 is typically made from a single sheet of strong, somewhat-flexible, or "semi-flexible", material. The term "semi-flexible" is used herein, in the specification and claims, to refer to a material which is sufficiently flexible to flex to the curved shape of the open state shown in FIG. 1B, while having sufficient intrinsic rigidity to form a load-bearing leg structure when in the open state. Examples of materials suitable for this purpose include, but are not limited to, polypropylene, other polymer sheet materials, thin sheet metal, and plywood.

Second panel element 14 need only flex in one direction, namely width-ways, while remaining rigid in its height dimension. In other words, in it's open state, lines normal to the surface of different parts of second panel element 14 point in different directions, but are all substantially horizontal. As a result, it may in some cases be advantageous to employ materials with more resistance to bending in one direction than in another. For example, second panel element 14 may be made from plastics with a corrugated or elongated-cellular internal structure. In this case, the corrugations or cells are arranged vertically, i.e., in a line from the lower to the upper edge of the panel element.

A further possibility for the internal structure of second panel element 14 employs a plurality of parallel rigid rods connected and held in spaced inter-relation by flexible connecting material. Here too, the rods are arranged to as to extend in a direction from the lower edge to the upper edge of second panel element 14.

A further optional feature, applicable to all of the embodiments described herein, is that the second panel element, and when used, a back-rest panel element, may be resiliently biased towards a slight curvature corresponding to the curvature of those elements in their open state. The biasing may be achieved by use of materials with a resilient memory, such as various plastics or thin sheet metal, formed with the appropriate initial curvature, or by addition of leaf springs or other biasing elements. The effect of this feature is to make the structure semi-automatic, springing between a fully open and fully closed state under an applied force. In the fully closed state, the biasing results in a slight curvature of the folded structure, but it remains a compact form with parallel adjacent layers otherwise similar to the folded state illustrated.

First panel element 12 is typically, but not necessarily, made from similar materials to second panel element 14. Here too, flexibility is required in one direction, namely, width-ways, while the element may be rigid in the perpendicular direction. It is important to note that first panel element 12 cannot be resiliently biased to any particular curvature since its curvature is negated, or even reversed, when structure 10 is closed from its open state to its folded state.

As mentioned above, second panel element 14 is hingedly attached to the lower surface of first panel element 12 at at least three points along upper edge 16 of second panel element 14. This attachment may be achieved by means of an array of hinges, or by a single continuous hinge extending along upper edge 16.

Any hinge structure may be employed. In a case that heat-weldable material, for example polypropylene, is used, upper edge 16 may be formed with a flange which is then heat-welded to the lower surface of first panel element 12. The hinge can be formed by scoring the material to produce a line of reduced thickness which is readily flexible.

The shape of upper edge 16 determines both the flexed shape of second panel element 14 in its open state and the corresponding curvature of first panel element 12. In the example shown, upper edge 16 is shaped as a concave curve. This generates an even curvature of both first panel element 12 and second panel element 14, as shown in FIG. 1B. Alternatively, upper edge 16 may be formed as a number of straight line segments, such as a truncated V-shape (as will be illustrated below with reference to FIGS. 3A and 3B). A further alternative is the use of a more complex curved shape. For example, a curved W-shape generates slight undulations in first panel element 12 to produce an ergonomically contoured seat surface (as will be illustrated below with reference to FIGS. 6A and 6B).

Typically, first panel element 12 is substantially perpendicular to second panel element 14 in the open state, although the exact angle between them may vary considerably according to aesthetic and structural considerations. The angle will generally lie in the range of between about 70° and about 100°.

In order to form a stable and functional item of furniture, first panel element 12 typically needs to be supported in more than one region. For this purpose, a hinge 18 is provided for attaching structure 10 to a wall 20. Hinge 18 is attached near to the middle of first panel element 12 such that it does not impede the required flexing between its folded and open states of structure 10.

Hinge 18 supports structure 10 in its folded state for convenient storage against wall 20, as shown in FIG. 1A. In the open state of structure 10 shown in FIG. 1B, hinge 18 anchors the rear of first panel element 12 to wall 20, thereby providing support and rigidity to structure 10.

Alternative secondary support may be provided by an additional panel element (not shown) similar to, but in spaced relation from, second panel element 14. In this case, structure 10 forms a bench-like free-standing structure. Conventional folding leg structures may also be used for secondary support.

Figure 2A:
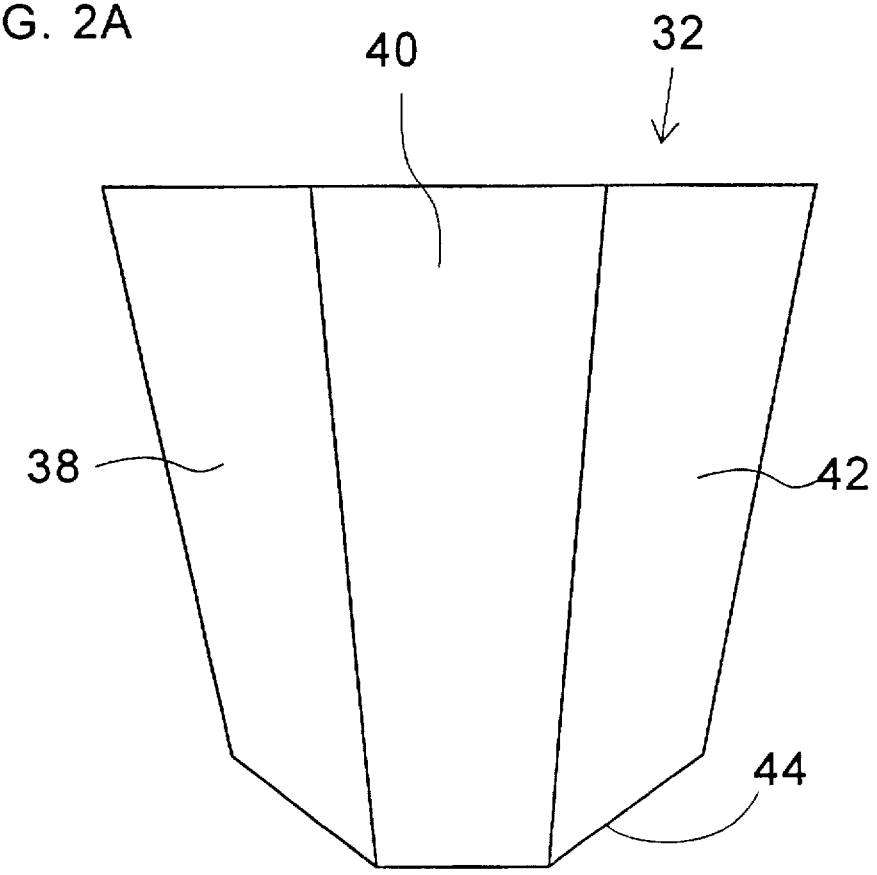
FIGS. 2A–2C are front views of three panel elements for use in a second embodiment of a foldable furniture structure, constructed and operative according to the teachings of the present invention.
Figure 2B:
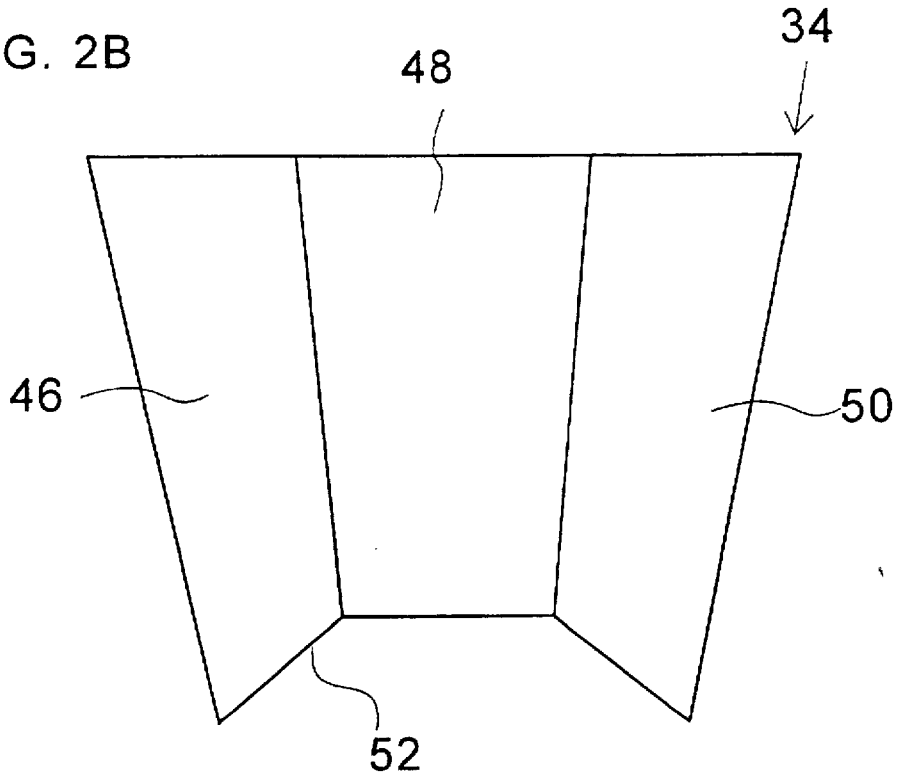

Turning now to FIGS. 2–3, a second embodiment of a folding furniture structure, generally designated 30, constructed and operative according to the teachings of the present invention, will be described. Structure 30 is essentially similar to structure 10, with each panel element made up of rigid panels hinged together. Structure 30 also features an additional back-rest panel element to form a fall chair structure.

Figure 2C:
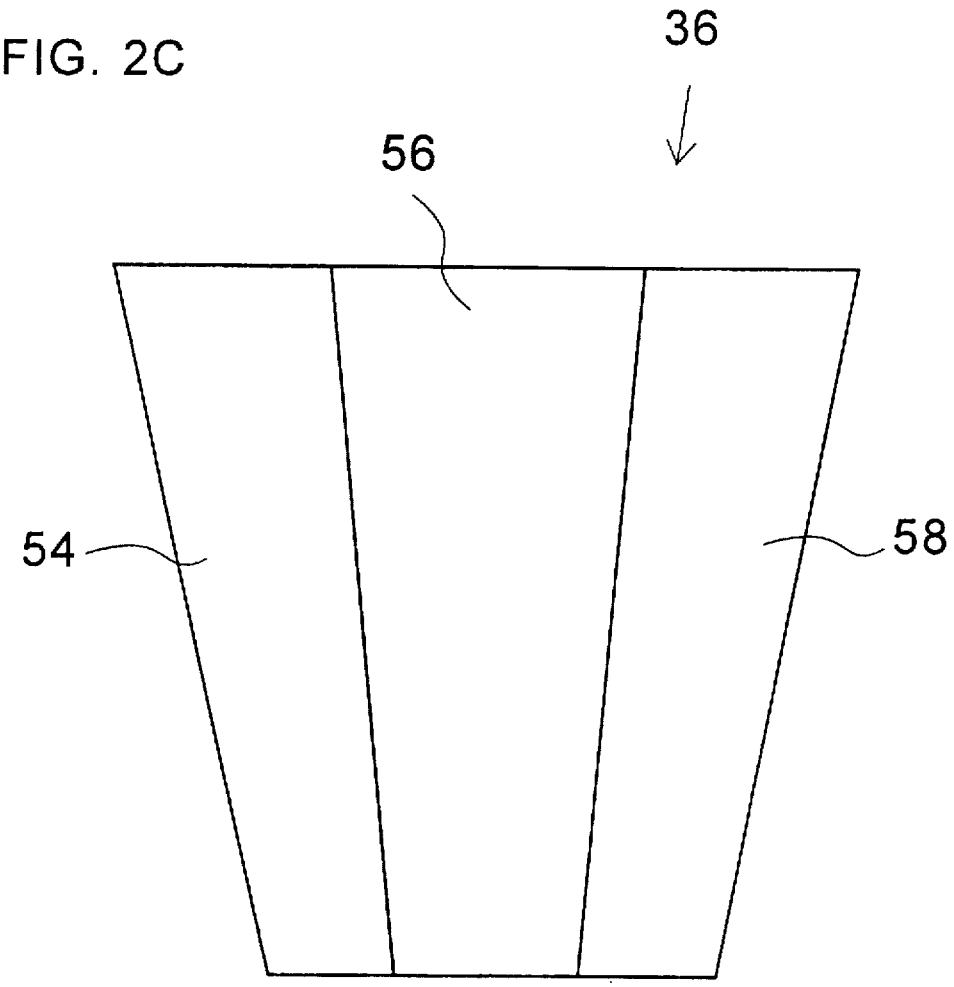

Thus, structure 30 includes a first panel element 32 (FIG. 2A), a second panel element 34 (FIG. 2B), and a third panel element 36 (FIG. 2C).

First panel element 32 is made up of three panels, denoted 38, 40 and 42, arranged side-by-side and providing abutting edges which are hingingly interconnected. The back edge 44 of first panel element 32 is made up of three straight line segments making up a truncated V-shape.

Second panel element 34, too, is made up of three panels, denoted 46, 48 and 50, also arranged side-by-side and providing abutting edges which are hingingly interconnected. The upper edge 52 of second panel element 34 (so called because of its position in the open state of structure 30, but shown here at the bottom of FIG. 2B) is also made up of three straight line segments making up a truncated V-shape in the opposite sense to lower edge 44.

Finally, third panel element 34 is also made up of three panels, denoted 54, 56 and 58, arranged side-by-side and providing abutting edges which are hingingly interconnected. The shape of the lower edge of third panel element 34 is not critical.

In each case, the hinge connection between the panels of each panel element may be of any type. In the case that polypropylene or similar material is used, each panel element may be formed as a unitary structure with a reduced-thickness line providing the required hinge effect.

The panels themselves are not necessarily continuous solid structures. Instead, open or covered frameworks of various types may be used. Similarly, a plurality of separate elements joined along a rod which acts as a common hinge may be used to function as a panel.

Figure 3A:
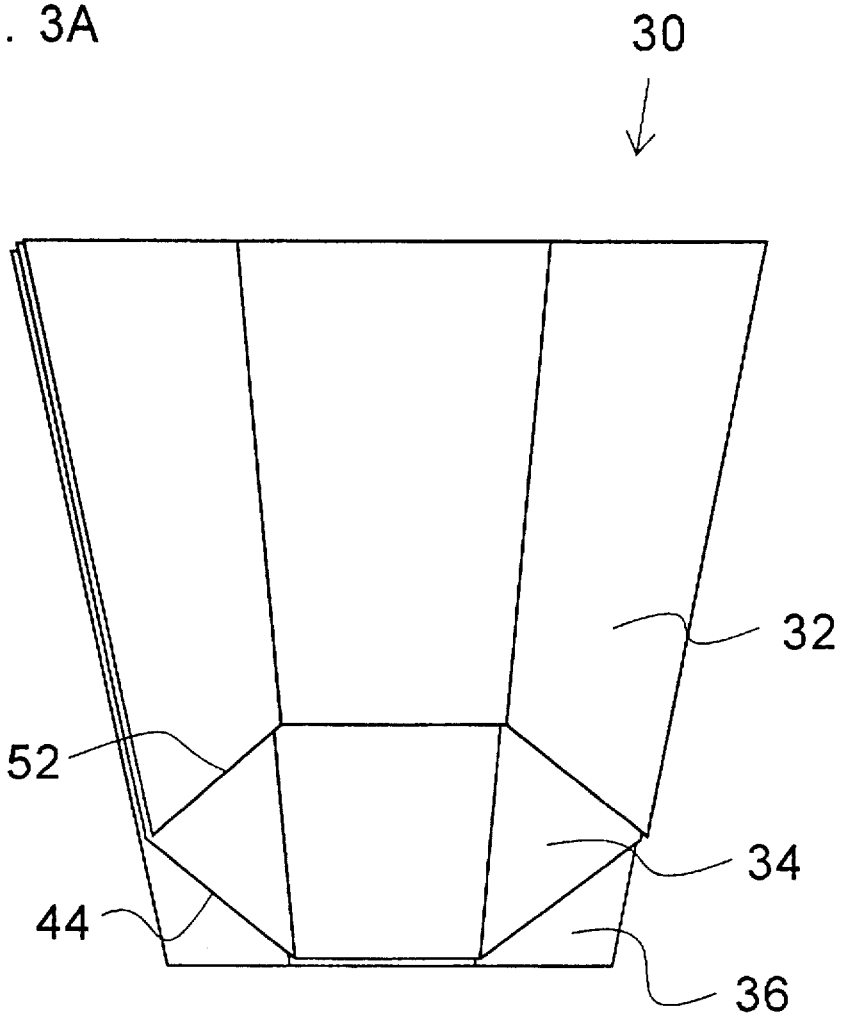
FIG. 3A is a schematic front view of a second embodiment of a foldable furniture structure assembled from the panel elements of FIGS. 2A–2C, constructed and operative according to the teachings of the present invention, the structure being shown in a closed state.
Figure 3B:
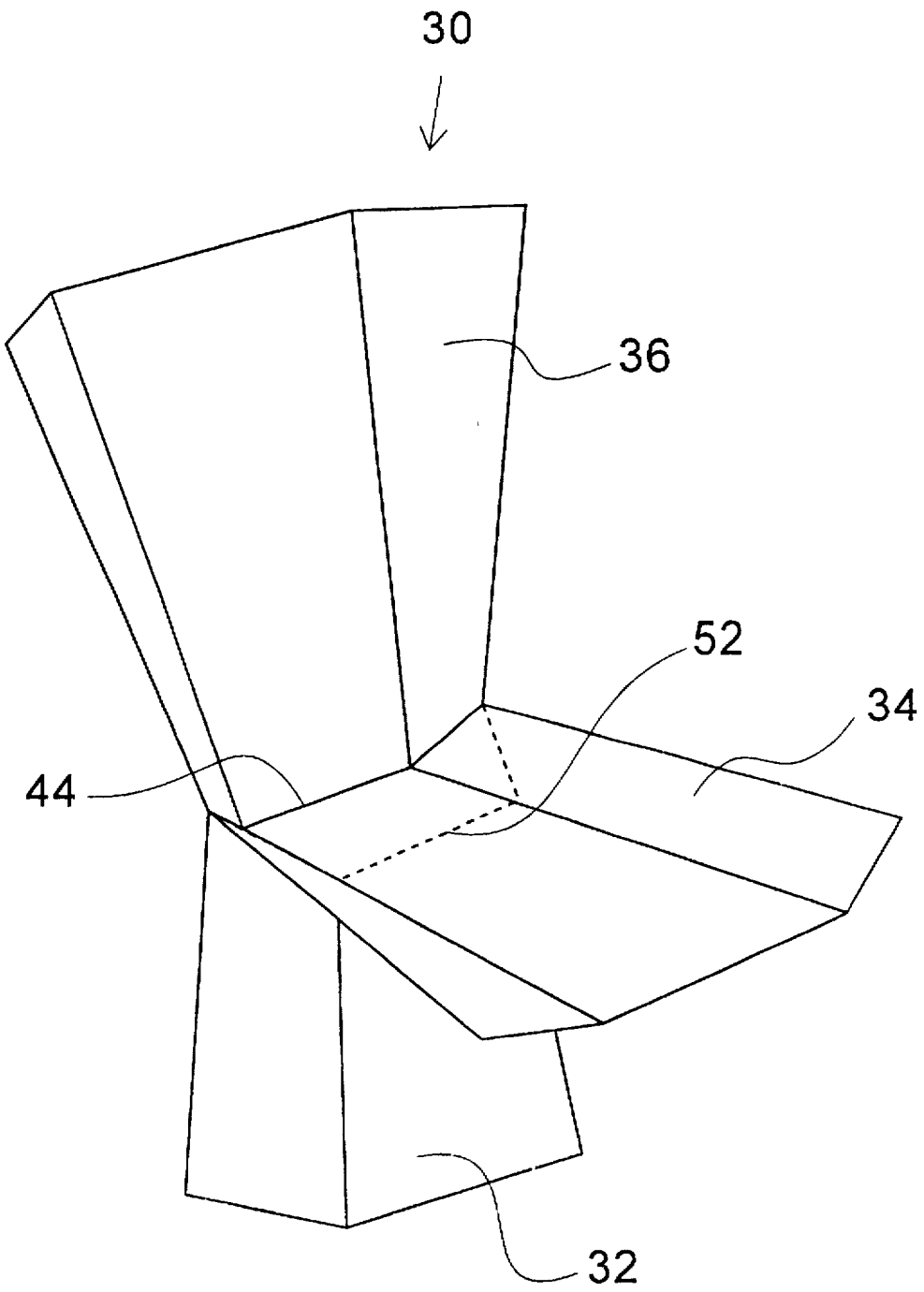
FIG. 3B is a schematic perspective view of the embodiment of FIG. 3A in an open state.

FIG. 3A shows structure 30 assembled in its folded state. Second panel element 34 is hingedly attached to first panel element 32 along upper edge 52. This combination of first panel element 32 and second panel element 34 is functionally equivalent to that of panel elements 12 and 14 described above. In addition, first panel element 32 is hingedly attached along back edge 44 to third panel element 34. Thus, in the folded state, all three panel elements lie parallel and adjacent, forming a highly compact layered package.

As second panel element 34 is opened away from first panel element 32, the non-collinear attachment along upper edge 52 induces flexing of both of the panel elements along their internal hinge lines. Concurrently, because of the inverted non-collinear attachment of first panel element 32 to third panel element 34 along back edge 44, flexing of first panel element 32 causes corresponding flexing of third panel element 34 in a sense opposite to that of second panel element 34. The sum result of these inter-relationships is that structure 30 opens in a single step to the open state shown in FIG. 3B.

Here again, it may be necessary to provide additional support to stabilize or lock the chair structure. For wall mounting, part, or all, of middle panel 56 of third panel element 34 may be fixed to a wall. For a free-standing design, the necessary stability may be achieved by providing a locking mechanism (not shown) for locking the chair in its open position. An example of such a locking mechanism would be a non-stretchable locking element attachable across the open side of the leg formed by second panel element 34.

Turning now to FIGS. 4–6, a third embodiment of a folding furniture structure, generally designated 60, constructed and operative according to the teachings of the present invention, will be described. Structure 60 is essentially similar to structure 10, with the second panel element formed as a collapsible tube to provide stand-alone stability. Structure 60 also features a back-rest panel element to form a full chair structure.

For convenience of description, structure 60 will be subdivided into a seat element 62 and a base 64 which will initially be described separately.

Figure 4A:
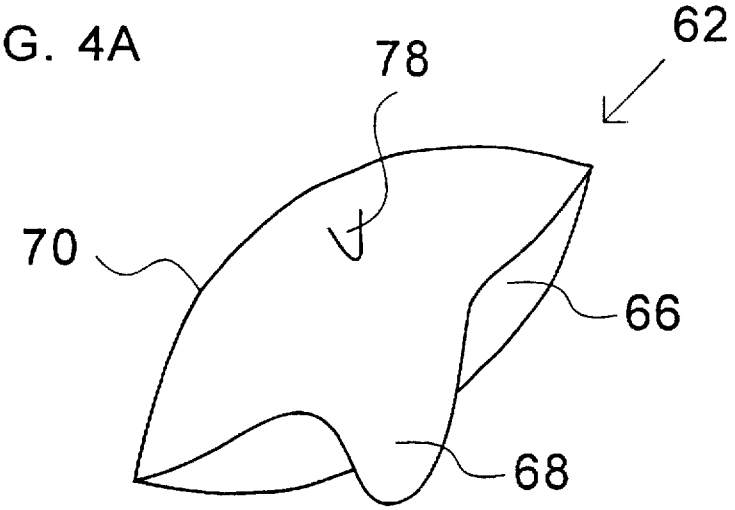
FIG. 4A is a schematic perspective view of a seat element of a third embodiment of a foldable furniture structure, constructed and operative according to the teachings of the present invention, in a closed state.
Figure 4B:
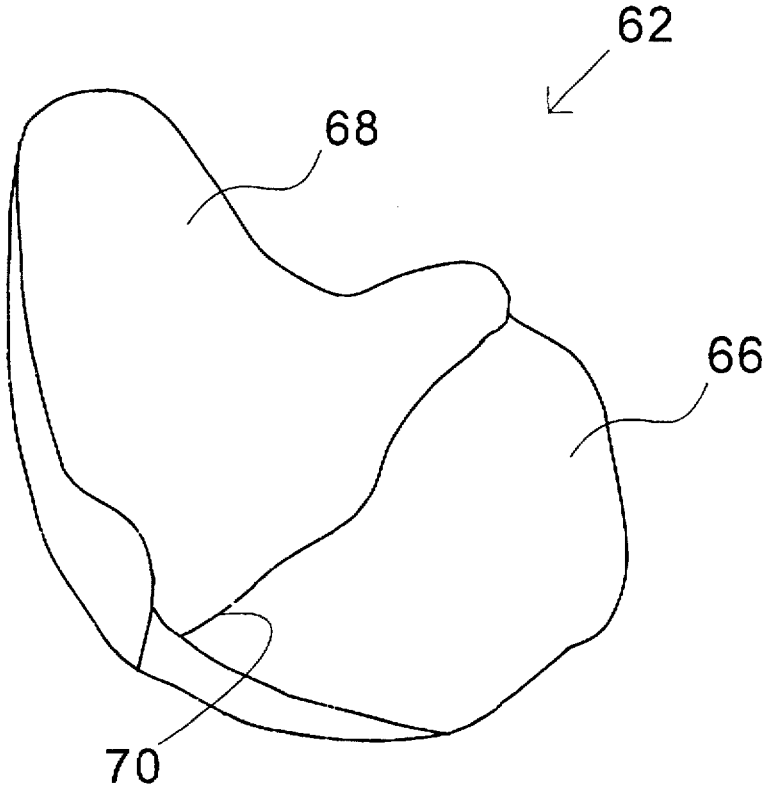
FIG 4B is a schematic perspective view of the seat element of FIG. 4A in an open state.

FIGS. 4A and 4B show seat element 62 in its folded and open states, respectively. Seat element 62 is made up of a first panel element 66 and a second panel element 68 which form, respectively, a seat and a back rest. Panel elements 66 and 68 are made of semi-flexible material hingedly attached along a curved seam 70 so as to fold between a closed position as shown in FIG. 4A in which they are parallel and adjacent, and an open position as shown in FIG. 4B in which first panel element 66 is at an angle to second panel element 68 to form a seat/back-rest arrangement.

The angle between first panel element 66 and second panel element 68 in the open position may vary considerably so long as it generates a relative geometry which is functionally operative as a seat/back-rest arrangement. A typical range might be from about 80° to about 110°. Similarly, the angle may vary across the breadth of seat element 62.

Figure 5A:
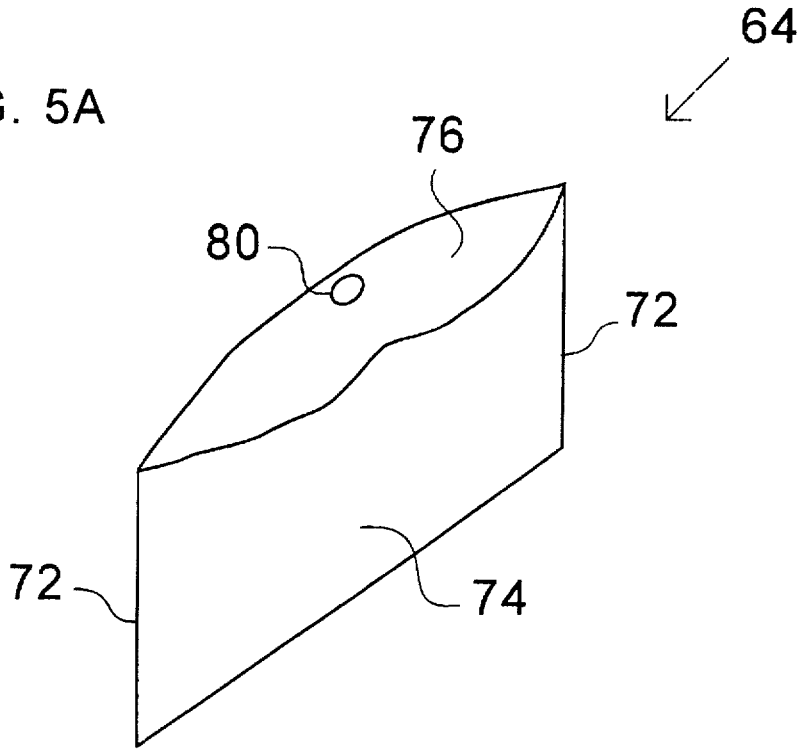
FIG. 5A is a schematic perspective view of a base element, constructed and operative according to the teachings of the present invention, for use with the seat element of FIG. 4A, the base element being shown in a closed state.
Figure 5B:
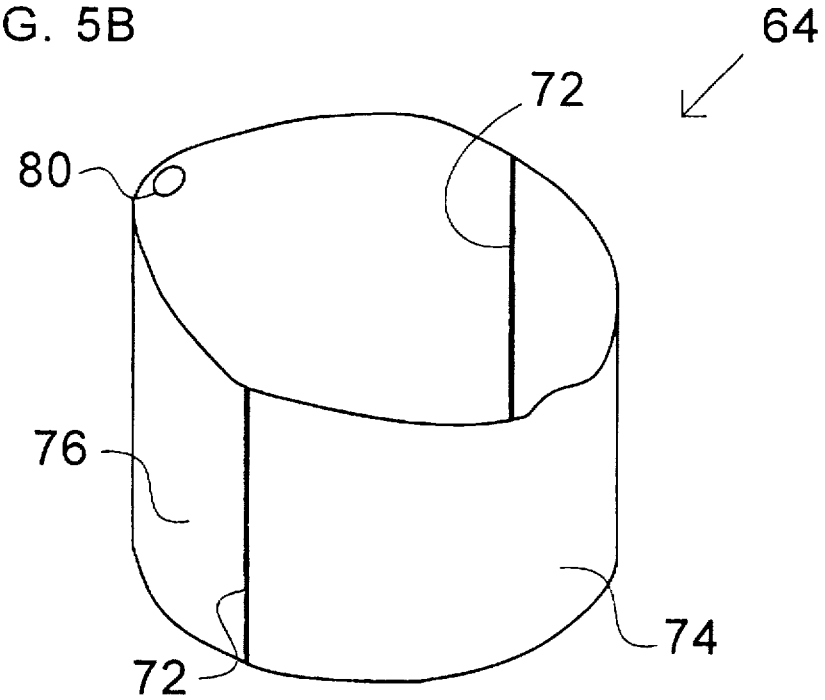
FIG. 5B is a schematic perspective view of the base element of FIG. 5A in an open state.

FIGS. 5A and 5B show a base 64 in the form of a collapsible tube formed from semi-flexible sheet-like material. Tube 64 is foldable along two opposite longitudinal folds 72 which subdivide the tube into a front panel 74 and a rear panel 76. Tube 64 is deployable between a substantially flat folded state as shown in FIG. 5A, and a hollow substantially cylindrical open state as shown in FIG. 5B.

It is important to note that tube 64 is not necessarily parallel sided. In fact, it is often preferable to form tube 64 as an upwardly-converging truncated cone, thereby providing increased stability. Even in this case, the open state is described as "substantially cylindrical" to distinguish it from the flat folded state.

Figure 6A:
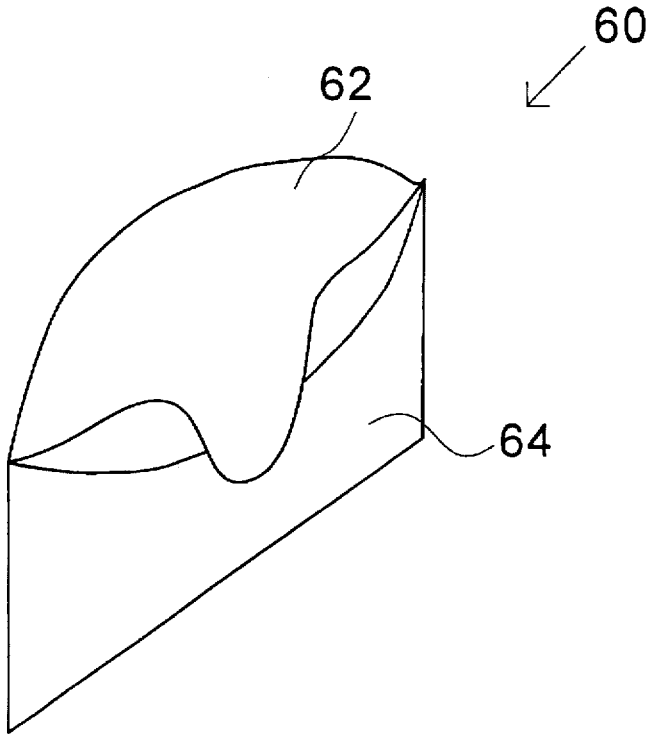
FIG. 6A is a schematic perspective view of a third embodiment of a foldable furniture structure, constructed and operative according to the teachings of the present invention, assembled from the seat and base elements of FIGS. 4A and 5A, the structure being shown in a closed state.
Figure 6B:
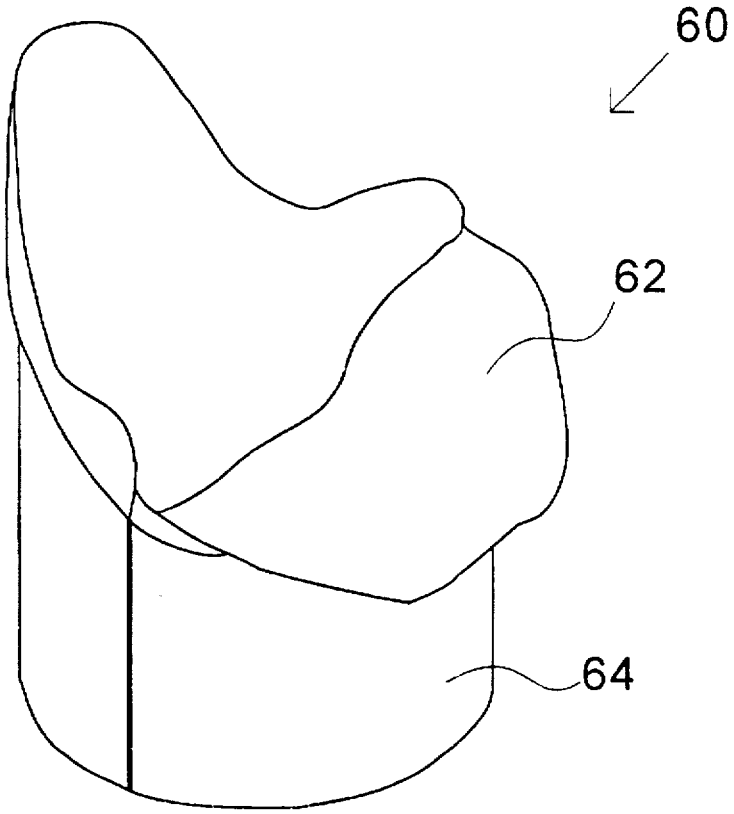
FIG. 6B is a schematic perspective view of the embodiment of FIG. 6A in an open state.

FIGS. 6A and 6B show structure assembled with seat element 62 hingedly attached to base 64. The attachment is made between first panel element 66 and the upper edge of front panel 74, preferably at at least three non-collinear points. This links the curvature of both first panel element 66 and front panel 74 to the relative angle between them, in the same manner as described with reference to FIGS. 1A and 1B, above. In this case, the contour of the upper edge of front panel 74 is shown as a curved W-shape (seen in FIGS. 5A and 5B), which produces an ergonomic chair-seat contour in the open state.

The combination of the non-collinear attachments between second panel element 68, first panel element 66, and front panel 74 inter-links the opening of seat element 62 and tube 64 such that structure 60 opens in a single manual step. In other words, by taking structure 60 in its closed state (FIG. 6A) and pulling apart first panel element 66 and second panel element 68, the entire structure opens up to its deployed state of FIG. 6B. Conversely, structure 60 also folds in a single operation.

Preferably, seat element 62 is shaped such that it rests on the upper edge of tube 64 over a large part of its length. Similarly, seat element 62 is preferably shaped such that, when in its deployed position, it pushes outwards against at least part of the upper edge of tube 64 so as to maintain the tube in its open state.

Optionally, a catch (not shown) may be provided for releasably locking seat element 62 in its deployed position. Typically, this is formed from a resilient projection 78 (FIG. 4A) from the rear of second panel element 68 which engages a corresponding opening 80 (FIG. 5B) in rear panel 76 when the chair is fully open.

Finally, it should be noted that the features described with reference to the above embodiments are generally interchangeable. Thus, for example, the tube base structure of FIGS. 4–6 may be formed from rigid panels similar to those of FIGS. 3A and 3B to produce a polygonal tube base.

It will be appreciated that the above descriptions are intended only to serve as examples, and that many other embodiments are possible within the spirit and the scope of the present invention.

What is claimed is:

1. A foldable furniture structure for supporting a load above a floor, the structure comprising:

(a) a first panel element having an upper surface for supporting a load and a lower surface, said lower surface being defined to have a first dimension delimited by a front edge and a back edge, and a second dimension perpendicular to said first dimension; and (b) a second panel element having a lower edge for resting on the floor and an upper edge directly hingedly attached at at least three non-collinear points to said lower surface of said first panel, said attachment being such that the structure is foldable between a closed state in which said first and second panel elements are substantially parallel and adjacent, and an open state in which said first panel element is at an angle to said second panel element, said non-collinear attachment inducing flexing of said first and second panel elements in said open state such that said second panel element forms a three-dimensional load-bearing leg structure with a major part of said upper edge supporting said lower surface of said first panel element at points removed from said front and back edges.

2. The structure of claim 1, wherein said second panel element is formed from a sheet of semi-flexible material.

3. The structure of claim 2, wherein said semi-flexible material is resiliently biased towards a slight curvature corresponding to the curvature of said second panel element in said open state.

4. The structure of claim 1, wherein said second panel element is formed from at least three rigid panels arranged side-by-side and providing abutting edges which are hingingly interconnected, said abutting edges extending in a direction from said lower edge to said upper edge of said second panel element.

5. The structure of claim 1, wherein said second panel element is attached to said lower surface of said first panel element by a single continuous hinge.

6. The structure of claim 5, wherein said continuous hinge is formed by heat-welding a polymer material.

7. The structure of claim 1, wherein said upper edge of said second panel element forms a concave curve.

8. The structure of claim 1, wherein said upper edge of said second panel element forms a truncated V-shape.

9. The structure of claim 1, wherein said upper edge of said second panel element is formed with a curved W-shape imparting an ergonomic seat contour to said first panel element.

10. The structure of claim 1, wherein said second panel element is implemented as a collapsible tube formed from semi-flexible sheet-like material, said tube being foldable along two opposite longitudinal folds to a substantially flat arrangement when the structure assumes its closed state, and a hollow substantially cylindrical open arrangement when the structure assumes its open state.

11. The structure of claim 1 for mounting on a wall, further comprising a hinge element for attaching an edge of said first panel element to the wall.

12. The structure of claim 1 for use as a chair, further comprising a third panel element having a lower edge hingedly attached at at least three non-collinear points to said upper surface of said first panel such that said third panel element lies substantially parallel and adjacent to said first panel element when the structure is in its closed state, and said third panel element assumes an upright position at an angle to said first panel element, when the structure is in its open state, thereby forming a back rest.

13. The structure of claim 1, further comprising a locking mechanism on the panels of the structure, said locking mechanism engaging a part of one of said panels by a part of the other of said panels to maintain a spatial relationship between said panels to maintain the structure in said open state.

14. A folding chair for supporting a subject above a floor, the chair comprising:

(a) a tube formed from semi-flexible sheet material, said tube being foldable along two opposite longitudinal folds such that said tube is deployable between a substantially flat folded state and a hollow substantially cylindrical open state, said tube having a lower edge for resting on the floor and an upper edge; and (b) a seat element having a first panel defined as having a first dimension delimited by a front edge and a back edge, and a second dimension perpendicular to said first dimension, said first panel being directly hingedly attached at at least one point removed from said front and back edges to said upper edge of said tube such that, when said tube is moved to its open state, said seat element is pivoted to a deployed position in which it rests on a major portion of said upper edge forming a chair, and when the tube is moved to its folded state, said seat pivots to a substantially flat storage position adjacent to said folded tube.

15. The folding chair of claim 14, wherein said seat element is shaped such that, when in said deployed position, said seat element pushes outwards against at least part of said upper edge of said tube so as to maintain said tube in its open state.

16. The folding chair of claim 14 wherein said seat element further includes a second panel hingingly attached at at least three non-collinear points to said first panel, said first and second panels being deployable between a folded state in which they are substantially parallel and adjacent, and a seat-forming state in which they angled apart.

17. The folding chair of claim 14, wherein said first panel is hingedly attached to said upper edge of said tube at at least three non-collinear points.

18. The folding chair of claim 14 further comprising a catch on one of said tube and said seat element for releasably locking said seat element relative to said tube in said deployed position.

* * * * *